United States Patent [19]

Winthrop

[11] Patent Number: 4,640,637

[45] Date of Patent: Feb. 3, 1987

[54] APPARATUS FOR DISPENSING AND APPLYING NAIL POLISH

[76] Inventor: Marilyn P. Winthrop, 54 Magnolia Hill, West Hartford, Conn. 06117

[21] Appl. No.: 612,081

[22] Filed: May 21, 1984

[51] Int. Cl.[4] ..... A46B 11/04

[52] U.S. Cl. ..... 401/101; 401/134; 401/135; 401/183; 132/74.5; 132/75

[58] Field of Search ..... 401/99, 101, 116, 117, 401/183, 184, 268, 269, 133, 134, 135, 202; 132/73, 73.5, 74.5, 75, 76.2

[56] References Cited

U.S. PATENT DOCUMENTS

| | | | |
|---|---|---|---|
| 824,688 | 6/1906 | Ferris | 401/202 |
| 1,442,662 | 1/1923 | Guinn | 15/191 A |
| 2,467,570 | 4/1949 | Ward | 15/167 B |
| 2,611,915 | 8/1952 | Prokop et al. | 401/116 |
| 2,623,231 | 12/1952 | Gutenstein | 401/116 |
| 3,071,113 | 1/1963 | Winchell | 401/134 |
| 3,192,552 | 7/1965 | King | 401/116 |
| 3,221,360 | 12/1965 | Seeman | 401/202 |
| 3,341,884 | 8/1967 | Pryor | 132/74.5 |
| 3,420,611 | 1/1969 | Towns | 401/99 |
| 3,481,676 | 12/1969 | Schwartzman | 401/134 |
| 3,565,540 | 2/1971 | Andrews | 401/135 |
| 4,155,663 | 5/1979 | Cerquozzi | 401/135 |
| 4,415,288 | 11/1983 | Gordon et al. | 401/132 |

FOREIGN PATENT DOCUMENTS

| | | | |
|---|---|---|---|
| 1052649 | 3/1959 | Fed. Rep. of Germany | 132/74.5 |
| 1087410 | 2/1955 | France | 132/74.5 |

*Primary Examiner*—Robert P. Swiatek
*Assistant Examiner*—Cary E. Stone
*Attorney, Agent, or Firm*—Robert S. Smith

[57] ABSTRACT

Apparatus for dispensing and applying nail polish, which includes an elongated, hollow housing having an opening at one axial extremity. A brush is mounted for axial movement between a first position inside the housing and a second position wherein at least a portion of the brush extends out of the housing. The apparatus also includes a reservoir, which may be either a fixed or removable cartridge, for nail polish. The reservoir is disposed within the housing and apparatus is provided for discharging nail polish from the reservoir onto the brush.

9 Claims, 3 Drawing Figures

APPARATUS FOR DISPENSING AND APPLYING NAIL POLISH

BACKGROUND OF THE INVENTION

The invention relates to personal care products and particularly to apparatus which holds a quantity of nail polish and which allows the user to selectively apply the polish to a small brush. The apparatus facilitates easy and precise application of the polish to the fingernails of the user.

Fingernail polish is commonly sold in small bottles having a cap and a brush assembly, which is used during application of the polish. Thus, since the brush and cap assemblies are ordinarily held in one hand while the polish is applied to the nails of the other hand, it is necessary for the user to set the bottle down while applying the polish. The bottle must, of course, be set on a surface so that it cannot be easily tipped over. The importance of avoiding tipping is, of course, twofold. First, the loss of the polish is undesirable. Secondly, the damage which may occur to any surface on which the polish is spilled is also undesirable. Not only must a flat, horizontal stable place be found for the bottle, but it is an additional requirement that the place where the bottle sits not be too far from the brush and cap assembly, since the normal procedure for applying polish necessitates repeated cycles of dipping the brush in the bottle and brushing the nail.

The problem with the conventional brush attached to the cap assembly used in conjunction with the bottle is that the polish is automatically deposited all over the brush when the brush is dipped in the liquid polish disposed in the bottle. This is undesirable since at the very least it requires a brush stroke to be taken across the edge of the bottle so as to remove excess polish. Even with this extra step to remove excess polish, optimum conditions for providing a uniform, smooth polish coating to a fingernail are not provided.

Typically the bottles in which the polish is sold are round bottles having a relatively small diameter, resulting in a package which is relatively difficult for a user to hold while applying polish with one hand to the other hand. Accordingly, it is very difficult for a woman to apply nail polish unless she is seated at a table or desk. This has the effect that it is often not possible to apply an original coat of polish or to repair an existing coat of polish. For example, it is difficult to apply fresh polish or repair a polish coating, even though the respective user may have time to accomplish the task.

It is an object of the invention to provide apparatus which will enable applying polish from a single assembly which will have storage means within it for holding a quantity of polish together with means for depositing that polish on a brush in a manner which will optimize the quality of the coating applied to a nail.

It is another object of the invention to provide apparatus which can be used more spontaneously than conventional nail polish dispensing and applying apparatus.

More specifically, it is an object of the invention to provide apparatus which has integral storage for nail polish together with means for applying the nail polish to an integral brush so that the repeated cycle of dipping, removing excess polish, and apply polish is simplified.

Still another object of the invention is to provide apparatus which will be compatible with the marketing of modules containing nail polish so that consumers will tend to purchase the prepackaged polish particularly intended for the apparatus in accordance with the present invention. This is significant to the manufacturer because it will provide linkages between the market for the apparatus and the market for the polish. This is significant for the consumer because it will provide a compact and convenient way to carry polish in either a purse or travel kit.

SUMMARY OF THE INVENTION

The foregoing objects and other objects and advantages which shall become apparent from the detailed description of the preferred embodiment are attained in an apparatus for dispensing and applying nail polish, which includes an elongated, hollow housing having an opening at one axial extremity, and a brush mounted for axial movement between a first position inside the housing and a second position wherein at least a portion of the brush extends out of the housing. Means are provided for axially translating the brush between the first position within the housing to the second position. The apparatus also includes a reservoir, which may be either a fixed or removable cartridge, for nail polish disposed within the housing and means for discharging nail polish from the reservoir onto the brush.

The elongated, hollow housing may be axially tapered and the housing may have a smaller circumferential dimension at one axial extremity than at the opposite axial extremity. The housing may have a generally truncated conical form. The reservoir may be elongated. The brush may have a plurality of bristles which are disposed in generally parallel relationship and the reservoir may be elongated and have the axis thereof disposed in generally parallel relationship to the bristles and the means for axially translating the brush may comprise a helix shaped member. The reservoir may be removable or permanently fixed in place and may be manufactured of plastic. The apparatus may include means for piercing the reservoir.

BRIEF DESCRIPTION OF THE ACCOMPANYING DRAWING

The invention will be better understood by reference to the accompanying drawing in which.

DESCRIPTION OF THE PREFERRED EMBODIMENT

Figure 1:
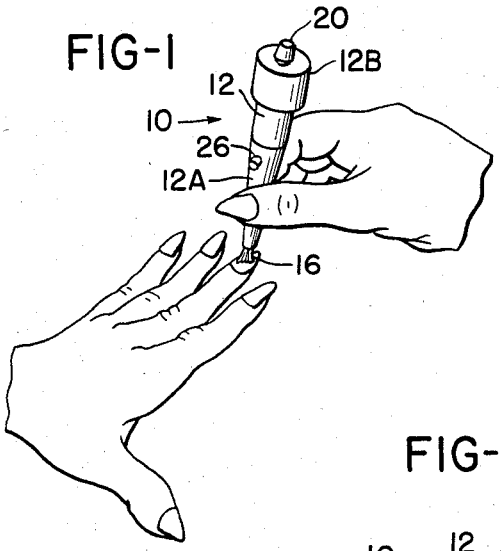
FIG. 1 is a perspective view of the apparatus in accordance with the invention being held in one hand while applying polish to the fingernail of the other hand.
Figure 2:
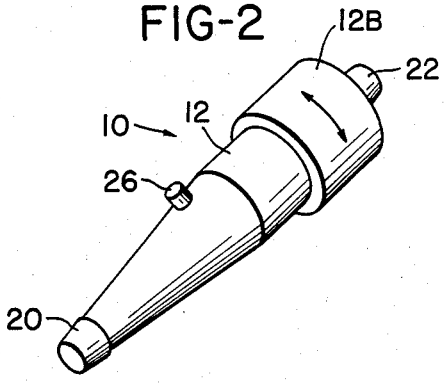
FIG. 2 is a perspective view of the apparatus in accordance with the invention.
Figure 3:
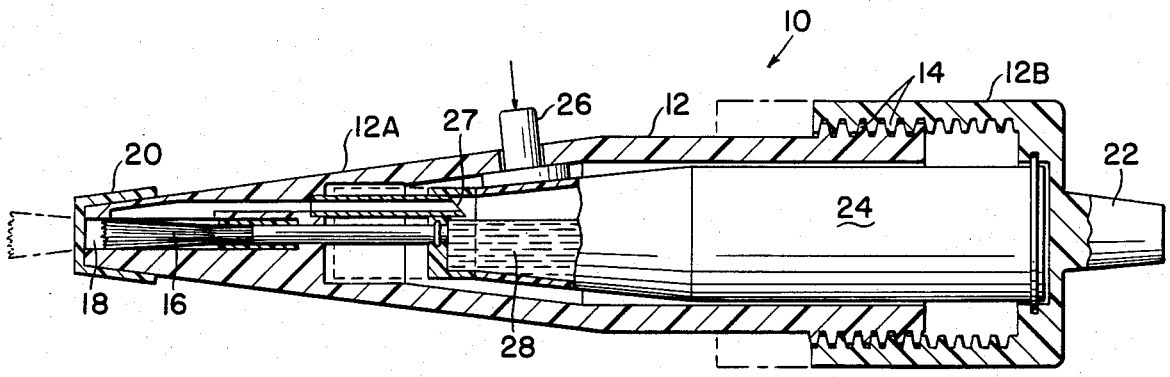
FIG. 3 is a sectional view taken along the geometric axis of the apparatus in accordance with the invention.

Referring now to FIGS. 1, 2, and 3, there is shown apparatus 10 for dispensing and applying nail polish 28. The apparatus 10 includes a housing 12, which is generally in the form of a truncated cone and has axial sections which are identified respectively as 12A and 12B. The housing 12 has an increasing diameter along the axial extent thereof. More particularly, the smallest diameter is at the lower extremity 12A, where the user grasps the housing 12, and the largest diameter is at the other axial extremity or section 12B. The first and second second axial extremities or sections 12A, 12B are mounted for rotation with respect to each other with a helix 14 coupled to the section 12B. Mounted for engagement with the helix 14 is a brush 16, which is moved axially in response to rotational movement of the section 12B. The housing section 12A has an opening 18 at the axial extremity most remote from the section 12B, which is covered by a cap 20 when the apparatus 10 is not in use. When the apparatus 10 is in use, the cap 20 is removed from the end of the section 12A, where it provides a substantially tight seal, and is placed on a holding surface or boss 22 at the opposite axial extremity of the section 12B. Disposed within the section 12B is a cartridge 24, which ordinarily is manufactured of a plastic and is ordinarily provided in a sealed condition. In addition to the polish 28 within the cartridge 24, there will ordinarily be a metal ball (not shown) to aid in mixing the polish 28. In the preferred form of the invention a point 27 in the housing 12A pierces the cartridge 24 as the cartridge 24 is installed in the housing 12. Disposed in the side of the housing 12A is button 26, which is movable radially with respect to the section 12A between a first position, which is spaced from the cartridge 24, and a second position wherein pressure is placed on the flexible cartridge 24 to displace the nail polish 28 within the cartridge 24 onto the brush 16.

In operation, the user removes the cap 20 from the housing section 12A. The cap 20 seals the opening 18 so that the brush 16 within the housing 12 is exposed to at least the vapors from the cartridge 24 to prevent drying of the brush 16, which would render it unusable. The cap 20 is placed on the boss 22 for storage during application of the nail polish 28. The housing section 12B is rotated with respect to the housing section 12A, causing the helix 14 to drive the brush 16 out through the hole or opening 18. The user then depresses the button 26, causing it to compress the cartridge 24 to deposit a quantity, typically a single drop, of the polish 28 on the brush 16 so that the user may apply the polish 28 with the brush 16 to the fingernails. Additional polish 28 is deposited on the brush 16 by repeated depressions of the button 26 during a given session in which the nails of both hands are being polished.

When polishing is completed, the housing section 12B is rotated with respect to the housing section 12A causing the brush 16 to retract into the housing section 12A through the opening 18.

The replacement cartridges 24, containing the same or different color polishes 28, will ordinarily be provided for the convenience of the user.

In various forms of the invention the housing 12 may be manufactured of plastic, metal or of other materials. In some embodiments the housing 12 will be intended to be refillable. In still other embodiments the apparatus will be disposable. In some embodiments, the boss 22 may have an elongated threaded member (not shown), extending into the housing 12. The threaded member may be turned with respect to the housing section 12B so that the volume of the cartridge 24 is decreased as the nail polish 28 is used up.

In some embodiments the cartridge 24 may be manufactured primarily of glass, because it resists the solvent in the polish 28 better. In such forms the cartridge 24 may have a rubber or other seal, which is pierced when the cartridge 24 is installed. Such predominantly glass catridges 24 may have an internal plunger (not shown) for displacing the polish 28. The plastic cartridge 24 will be most resistant to breaking, although even a glass cartridge 24 will be protected from shocks by the housing 12.

The invention has been described with reference to its illustrated preferred embodiment. Persons skilled in the art of constructing personal care products may, upon exposure to the teachings herein, conceive variations in the mechanical development of the components therein. Such variations are deemed to be encompassed by the disclosure, the invention being delimited only by the appended claims.

Having thus described my invention, I claim:

1. Apparatus for dispensing and applying nail polish, which comprises:

an elongated, hollow housing having an opening at one axial extremity;

a brush having a plurality of bristles, said bristle having a first end and a second end which is a free end, said brush being mounted for axial movement between a first position inside said housing and a second position;

means for axially translating said brush between said first position within said housing and a second position wherein at least a portion of said brush extends out of said housing;

a reservoir for nail polish disposed within said housing; and means for discharging nail polish from said reservoir onto said brush comprising a passageway extending between said reservoir and said free end of said bristles said means for discharging comprises a button which is movable between a first position in which said button is positioned to deform and reduce the volume of said reservoir and a second position in which said button does not deform and reduce the volume of said reservoir.

2. The apparatus as described in claim 1, wherein: said elongated, hollow housing is axially tapered.

3. The apparatus as described in claim 2, wherein: said housing has an axial section having the general form of a truncated form.

4. The apparatus as described in claim 3, wherein: said reservoir is elongated.

5. The apparatus as described in claim 4, wherein: said means for axially translating said brush comprises a helix shaped member.

6. The apparatus as described in claim 5, wherein: said reservoir is manufactured of plastic.

7. The apparatus as described in claim 6, wherein: said apparatus includes means for piercing said reservoir.

8. The apparatus as described in claim 7, further including: a discrete cap dimensioned and configured for engaging said one axial extremity of said housing.

9. The apparatus as described in claim 8, further including: a boss disposed at said opposite axial extremity of said housing which is dimensioned and configured for engagement with said cap.

* * * * *